US012196058B1

(12) United States Patent
Alshaikh et al.

(10) Patent No.: US 12,196,058 B1
(45) Date of Patent: Jan. 14, 2025

(54) SUBSURFACE SAFETY VALVE SYSTEMS, ISOLATION TOOLS, AND METHODS OF LOCKING SUBSURFACE SAFETY VALVES

(71) Applicant: Saudi Arabian Oil Company, Dhahran (SA)

(72) Inventors: Eyad Bin Alshaikh, Dhahran (SA); Ibrahim Magbool Al-Maadi, Dhahran (SA); Hamad Farhan Alanazi, Riyadh (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/508,548

(22) Filed: Nov. 14, 2023

(51) Int. Cl.
*E21B 23/02* (2006.01)
*E21B 23/06* (2006.01)
*E21B 34/10* (2006.01)

(52) U.S. Cl.
CPC ..... *E21B 34/105* (2013.01); *E21B 23/06* (2013.01); *E21B 2200/06* (2020.05)

(58) Field of Classification Search
CPC .... E21B 23/02; E21B 34/105; E21B 2200/05; E21B 2200/06; E21B 23/06
See application file for complete search history.

(56) References Cited

U.S. PATENT DOCUMENTS 4,356,867 A * 11/1982 Carmody ..... E21B 34/102 166/373
4,624,315 A * 11/1986 Dickson ..... E21B 34/102 166/323
4,723,606 A * 2/1988 Vinzant ..... E21B 34/102 166/332.1
5,165,480 A 11/1992 Wagoner et al.
7,717,185 B2 * 5/2010 Anderson ..... E21B 34/102 166/332.8
9,745,830 B2 8/2017 Lake
10,920,529 B2 * 2/2021 Mailand ..... E21B 41/0021

FOREIGN PATENT DOCUMENTS

GB 2213181 A * 8/1989 ..... E21B 34/102

* cited by examiner

*Primary Examiner* — Matthew R Buck
(74) *Attorney, Agent, or Firm* — DINSMORE & SHOHL LLP

(57) ABSTRACT

A subsurface safety valve includes an interior bore extending along an entire length of the subsurface safety valve, a valve actuatable between an open position and a closed position, and a locking recess for securing an isolation tool within the interior bore. The isolation tool includes a locking mandrel having a fish neck disposed on an upper surface of the locking mandrel, the locking mandrel engaging the locking recess of the subsurface safety valve, and a sleeve threadedly coupled to the locking mandrel. A hydraulic valve assembly is disposed fluidly downstream of the locking recess, the hydraulic valve assembly having one or more apertures fluidly coupling an upper portion of the wellbore to a lower portion of the wellbore. A control line controls the subsurface safety valve at a surface of the wellbore.

14 Claims, 4 Drawing Sheets

SUBSURFACE SAFETY VALVE SYSTEMS, ISOLATION TOOLS, AND METHODS OF LOCKING SUBSURFACE SAFETY VALVES

TECHNICAL FIELD

The present specification generally relates to tools for drilling operations, and more specifically to tools for subsurface safety valves.

BACKGROUND

Subsurface safety valves are commonly deployed in drilling operations as a means to shut-in a wellbore in the event the integrity of a surface wellhead is compromised during operation. However, current safety valves commonly experience a number of failures and malfunctions when engaged. For instance, over time, damage to the safety valve may result in uncommanded closure of the safety valve during production. This uncommanded closure may result in wireline that extends through the safety valve being severed, which may in turn cause the wireline and additional toolstring gear to be lost within the wellbore. Thus, a need exists for additional tools or methods capable of ensuring that safety valves are not inadvertently closed during production.

SUMMARY

In an embodiment, a subsurface safety valve is disclosed. The subsurface safety valve includes an interior bore extending along an entire length of the subsurface safety valve, a valve actuatable between an open position and a closed position, and a locking recess for securing an isolation tool within the interior bore. The isolation tool includes a locking mandrel having a fish neck disposed on an upper surface of the locking mandrel, the locking mandrel engaging the locking recess of the subsurface safety valve, and a sleeve threadedly coupled to the locking mandrel. A hydraulic valve assembly is disposed fluidly downstream of the locking recess, the hydraulic valve assembly having one or more apertures fluidly coupling an upper portion of the wellbore to a lower portion of the wellbore. A control line controls the subsurface safety valve at a surface of the wellbore.

In another embodiment, an isolation tool is disclosed. The isolation tool includes a locking mandrel configured to engage a locking recess of the subsurface safety valve, and the locking mandrel includes a fish neck disposed on an upper surface of the locking mandrel and a plurality of locking keys configured to lock the locking mandrel in an open position. The isolation tool further includes a sleeve threadedly coupled to the locking mandrel, the sleeve including a tubular body having an exterior surface shaped to correspond with an interior bore of the subsurface safety valve, and an interior surface defining an internal bore for use in a wellbore. When the isolation tool is coupled to the subsurface safety valve, a safety clearance exists between the tubular body of the sleeve and the subsurface safety valve In yet another embodiment, a method of coupling an isolation tool to a subsurface safety valve is disclosed. The method includes positioning a subsurface safety valve having an interior bore into a wellbore; coupling a slickline to a locking mandrel of the isolation tool; positioning the isolation tool within the interior bore of the subsurface safety valve in the wellbore; securing the isolation tool to the subsurface safety valve by coupling the locking mandrel of the isolation tool to a locking recess of the subsurface safety valve; testing the integrity of the coupling between the isolation tool and the subsurface safety valve; decoupling the slickline from the isolation tool; and removing the slickline from the wellbore These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1A:
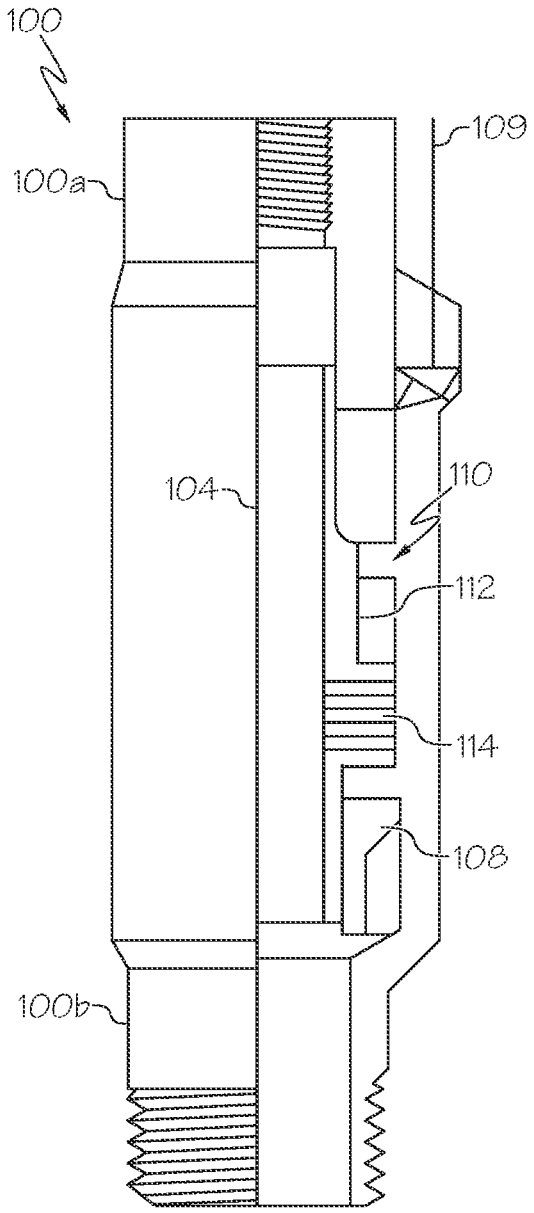
FIG. 1A depicts a partial cross-sectional schematic view of a subsurface safety valve in an open position, according to one or more embodiments shown and described herein.

Embodiments disclosed herein relate to subsurface safety valves, isolation tools, and methods of locking subsurface safety valves. More specifically, the present disclosure includes an isolation tool that includes a locking mandrel having a fishneck disposed on an upper surface of the locking mandrel, the locking mandrel being configured to engage a locking recess of the subsurface safety valve.

As disclosed herein, the subsurface safety valve may include an interior bore extending along an entire length of the subsurface safety valve, a valve actuatable between an open position and a closed position, and a locking recess for securing an isolation tool within the interior bore. The isolation tool includes a locking mandrel having a fish neck disposed on an upper surface of the locking mandrel, the locking mandrel engaging the locking recess of the subsurface safety valve, and a sleeve threadedly coupled to the locking mandrel. A hydraulic valve assembly is disposed fluidly downstream of the locking recess, the hydraulic valve assembly having one or more apertures fluidly coupling an upper portion of the wellbore to a lower portion of the wellbore. A control line controls the subsurface safety valve at a surface of the wellbore. By securing (e.g., locking) the subsurface safety valve in the open position, the disclosed isolation tool may act as a safeguard to ensure that sudden malfunction of the valve is prevented during wellbore operations.

As provided herein, the term "isolation tool" may generally refer to any tool that may be passed over a wireline and secured to and/or within a subsurface safety valve such that the tool extends into and at least partially through the subsurface safety valve in order to lock the subsurface safety valve in a desired position.

As provided herein, the term "safety valve" may generally refer to a valve designed to automatically shut-in the flow of a wellbore in the event surface controls fail or surface equipment becomes damaged.

As provided herein, the term "subsurface safety valve" may refer to a safety valve which includes a subsurface control mechanism designed to automatically close (e.g., actuated by the pressure differential/flow velocity across the safety valve) when a predetermined flow condition occurs in the wellbore.

As provided herein, the term "tubing retrievable subsurface safety valve ('TRSSSV')" may refer to a type of subsurface safety valve that is formed as part of the well tubing and includes an opening (e.g., bore, etc.) having an inner diameter sufficiently large enough to allow for a variety of tools to be passed therethrough.

As provided herein, the term "slickline" may refer to a thin, nonelectric cable used for selective placement and retrieval of wellbore hardware, such as plugs, gauges, and valves located in mandrels.

As provided herein, the term "wireline" may refer to an electric cable used to lower tools into a borehole and to transmit data to a control system positioned at a surface of the borehole.

As provided herein, the term "well intervention operations" may refer to activities performed on an oil or gas well to restore, enhance, and/or maintain its productivity. These operations may include operations to optimize well performance, address production issues, or perform maintenance tasks. For example, well intervention operations may include, but are not limited to, well stimulation, well logging, wellhead maintenance, tubing and/or casing repair, plug and abandonment operations, well cleanout, and/or perforation.

As provided herein, the term "fishneck" may refer to a region of a subsurface safety valve or other drill string member having a reduced diameter at or near an upper portion of the safety valve. The fishneck may be used to couple fishing tools (e.g., isolation tool, etc.) to the subsurface safety valve.

As provided herein, the term "nipple" may refer to a component fabricated as a section and/or portion of a wall (e.g., tubular wall or otherwise) and having an internal surface that provides a seal area and a locking profile.

As discussed herein, many currently used subsurface safety valves present a number of reliability issues that often require substantial repairs throughout operation of the valve. For example, malfunctions with the subsurface safety valve may result in unprompted closing of the valve, which can crush or rupture the control lines used to operate the valve, or the wireline that extends through the valve. Further still, the unprompted closure of the safety valve can cause leaks in the seals and/or junctions of the valve. When subsurface safety valves having pressure hydraulic valve assemblies are employed, leaks within the seals and/or junctions of the valves may render the valves inoperable, as equalized pressure may be required to open the valve. Moreover, these malfunctions are not easily remedied, and often require removing the subsurface safety valve from the wellbore entirely in order to repair. However, in accordance with an embodiment of the present invention, an isolation tool having a body that extends into and through an interior bore of the safety valve may be deployed in order to effectively secure the valve in an open position. By securing (e.g., locking) the subsurface safety valve in the open position, the disclosed isolation tool may act as a safeguard to ensure that sudden malfunction of the valve is prevented during wellbore operations.

Embodiments of the subsurface safety valve, isolation tool, and methods of locking a subsurface safety valve will now be described in more detail herein. The following will now describe these tools and methods in more detail with reference to the drawings and where like numbers refer to like structures.

Figure 1B:
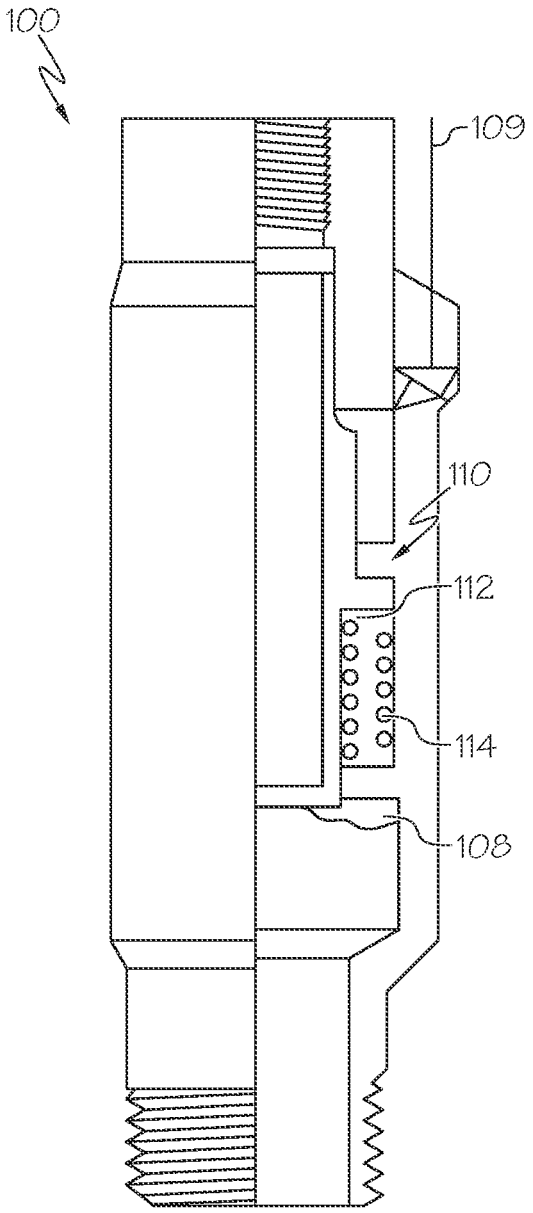
FIG. 1B depicts a partial cross-sectional schematic view of a subsurface safety valve in a closed position, according to one or more embodiments shown and described herein.

Referring now to FIGS. 1A and 1B, a subsurface safety valve 100, such as a TRSSSV, is depicted in an open (FIG. 1A) and closed (FIG. 1B) position. The subsurface safety valve 100 may include an interior bore 104, which may extend along an entire length of the subsurface safety valve 100 (e.g., between a proximal end 100*a* and a distal end 100*b* of the subsurface safety valve 100). In some embodiments, the interior bore 104 may have a diameter that is sufficiently large to accommodate a slickline or other similar device, such that a wellbore may be accessible through the interior bore 104.

Referring still to FIGS. 1A and 1B, the subsurface safety valve 100 may be further equipped with a hinged valve 108, such as a flapper valve, which may be actuatable between an open position and a closed position using a control line 109. When adequate reservoir pressure is maintained within the subsurface safety valve 100, the hinged valve 108 may remain in the open position, such that the wellbore is accessible through the interior bore 104 of the subsurface safety valve 100. However, if the pressure within the subsurface safety valve 100 drops below a predetermined threshold (e.g., as occurs in the beginning stages of losing control of the wellbore), the hinged valve 108 may be actuated to the closed position. In these embodiments, "adequate reservoir pressure" may be determined by adding the reservoir pressure to the pressure supplied by the hinged valve 108 (e.g., via a spring or other similar mechanism) and subtracting the hydrostatic pressure of hydraulic fluid inside the control line 109.

Although the hinged valve 108 may be configured to actuate from the open position to the closed position when pressure within the subsurface safety valve 100 drops below the predetermined threshold, it should be appreciated that, in some embodiments, malfunctions within the subsurface safety valve 100 may cause the hinged valve 108 to actuate to the closed position unprompted. To alleviate the risk of the hinged valve 108 inadvertently actuating to the closed position, an isolation tool may be disposed within the interior bore 104 of the subsurface safety valve 100, as will be described in additional detail herein with reference to FIGS. 2 and 3.

Referring still to FIGS. 1A and 1B, hydraulic pressure may be communicated across the subsurface safety valve 100 to open and close the hinged valve 108 using a hydraulic valve assembly 110. In these embodiments the hydraulic valve assembly 110 may include a sleeve, such as a control sleeve 112, and a spring mechanism 114, with the control sleeve 112 being configured to compress the spring mechanism 114 to actuate the subsurface safety valve 100 from the open position (FIG. 1A) to the closed position (FIG. 1B). For example, as depicted in FIG. 1A, the control sleeve 112 may apply a compressive force to the spring mechanism 114 when hydraulic pressure is applied across the subsurface safety valve 100 in order to move the subsurface safety valve 100 to the open position. In contrast, when hydraulic pressure is reduced (e.g., across a cross-sectional area of the subsurface safety valve 100), the force applied by the control sleeve 112 on the spring mechanism 114 may be relieved, such that the spring mechanism 114 is decompressed and the subsurface safety valve 100 may move to the closed position (FIG. 1B). In the embodiments described herein, the opening and closing of the subsurface safety valve 100 may further correspond to the opening and closing of the hinged valve 108.

Figure 2:
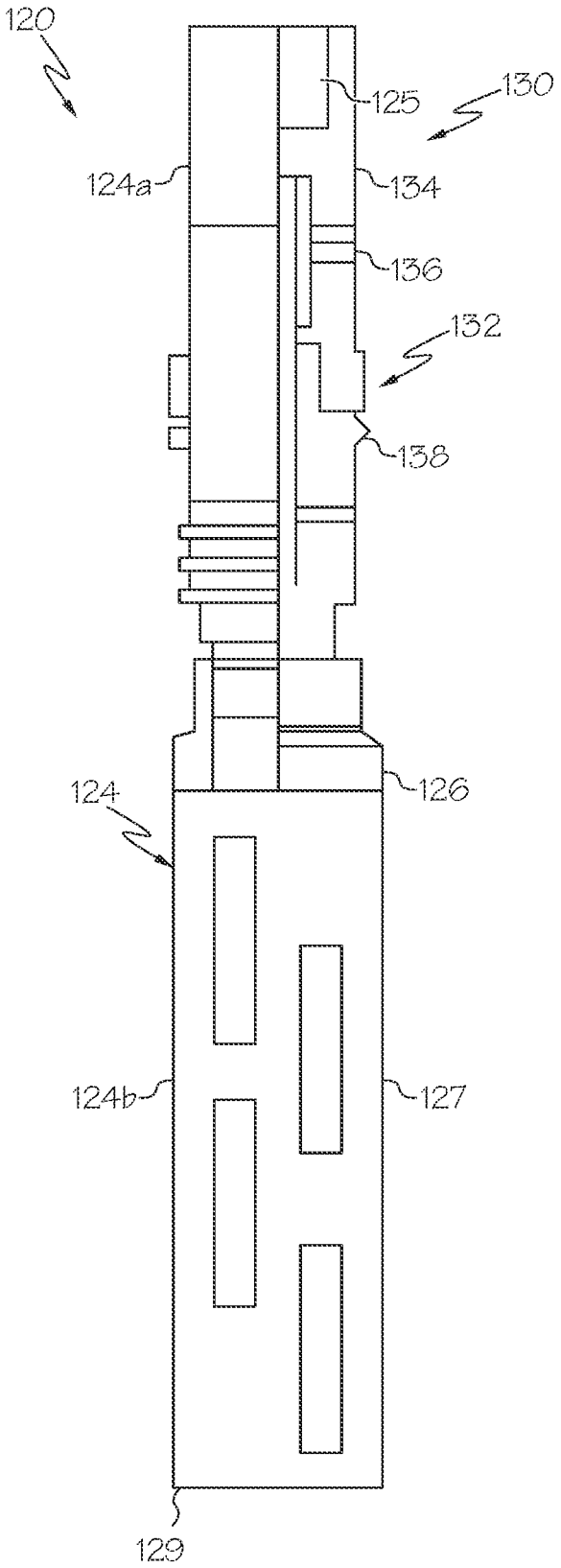
FIG. 2 depicts a partial cross-sectional view of an isolation tool, according to one or more embodiments shown and described herein.

Referring now to FIG. 2, an isolation tool 120 for use in connection with the subsurface safety valve 100 of FIGS. 1A and 1B is depicted. In these embodiments, the isolation tool 120 may include a body 124 extending between an upper portion 124*a* and a lower portion 124*b*, with the upper portion 124*a* and the lower portion 124*b* being connectable via a threaded connection 126.

As further depicted in FIG. 2, the upper portion 124*a* may include a fishneck 125, which may be configured for coupling with a slickline, or other similar component allowing for the installation and/or removal of the isolation tool 120 from within a wellbore. For example, in the event of a failure or other emergency incident within the wellbore, the fishneck 125 formed within the upper portion 124*a* of the isolation tool 120 may allow for the isolation tool 120 to be quickly and easily removed from the subsurface safety valve 100. In the embodiments described herein, the upper portion 124*a* may be a stainless steel section, which is manufactured to withstand high pressures and high temperature that may be encountered within the wellbore and/or during wellbore processes.

Referring still to FIG. 2, the upper portion 124*a* of the isolation tool 120 may include a locking mandrel 130. In these embodiments, the locking mandrel 130 may be configured to be secured within the subsurface safety valve 100 in order to lock the isolation tool 120 within the interior bore 104 of the subsurface safety valve 100 during operation, as will be described in additional detail herein with reference to FIG. 3.

The locking mandrel 130 may further include a locking assembly 132, which may be used to move the locking mandrel 130 from a locked to an unlocked position. In these embodiments, the locking assembly 132 may include an expanding mechanism 134, a mandrel spring mechanism 136, and a plurality of locking keys 138 that may be manipulated to lock and unlock the locking mandrel 130. It should be appreciated that, in the embodiments described herein, the locking mandrel 130 may be moved to the unlocked (e.g., open) position prior to being inserted within the subsurface safety valve 100, and may be moved to the locked (e.g., closed) position once the locking mandrel 130 is secured to the subsurface safety valve 100, as will be described in additional detail herein with reference to FIG. 3.

Referring still to FIG. 2, the expanding mechanism 134 may be expanded and contracted to apply a force on the mandrel spring mechanism 136, which may in turn actuate the plurality of locking keys 138 from the unlocked position to the locked position. For example, when the expanding mechanism 134 expands, the expanding mechanism 134 may apply a compressive force on the mandrel spring mechanism 136, which may in turn cause the plurality of locking keys 138 to be moved to the unlocked position.

As further depicted in FIG. 2, the lower portion 124*b* of the isolation tool 120 may define a sleeve 127 that extends into and through the interior bore 104 of the subsurface safety valve 100, as will be described in additional detail herein with reference to FIG. 3. In these embodiments, the sleeve 127 may be an open sleeve, such that the sleeve 127 defines an internal bore 129 that extends through at least the lower portion 124*b* of the isolation tool 120. Furthermore, in some embodiments, the internal bore 129 may extend along the entire length of the isolation tool 120 (e.g., between the upper portion 124*a* and the lower portion 124*b*), such that the wellbore may remain accessible through the internal bore 129 of the isolation tool 120 when the isolation tool 120 is installed within the subsurface safety valve 100. Accordingly, the internal bore 129 may allow for pressure to be equalized across the subsurface safety valve 100 when the isolation tool 120 is installed.

In the embodiments described herein, the lower portion 124*b* of the isolation tool 120 may be a brass section. For example, brass materials may be capable of maintaining the subsurface safety valve 100 in the open position without damaging internal components of the subsurface safety valve 100. Additionally, it should be appreciated that brass material may be non-magnetic and non-sparking, which may help to ensure that the lower portion 124*b* does not spark and/or attract magnetized components within the subsurface safety valve 100 when the lower portion 124*b* is positioned within the interior bore 104.

Figure 3:
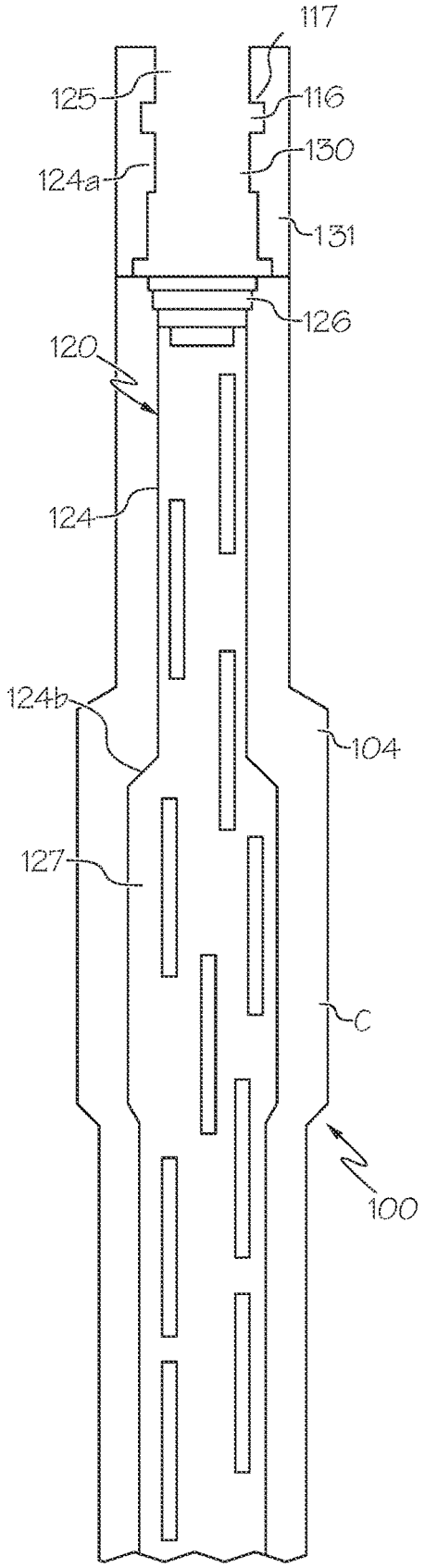
FIG. 3 depicts a cross-sectional schematic view of the isolation tool positioned within the subsurface safety valve, according to one or more embodiments shown and described herein.

Referring now to FIG. 3, the isolation tool 120 is illustrated positioned within the subsurface safety valve 100. In these embodiments, the isolation tool 120 may be deposited within the interior bore 104 of the subsurface safety valve 100 such that the upper portion 124*a* of the body of the isolation tool 120 is located upstream of at least the hinged valve 108 (shown in FIGS. 1A and 1B). However, in some embodiments, such as the embodiment depicted in FIG. 3, the upper portion 124*a* may be positioned upstream of the hydraulic valve assembly 110 (shown in FIGS. 1A and 1B).

In order to secure the upper portion 124*a* of the body 124 of the isolation tool 120 within the subsurface safety valve 100, a shoulder 131 of the upper portion 124*a* of the body 124 may engage with a nipple 116 formed within the interior bore 104 of the subsurface safety valve 100. For example, the nipple 116 formed within the subsurface safety valve 100 may be a landing nipple, which may have a reduced diameter internal profile configured to prevent the upper portion 124*a* of the isolation tool 120 from passing downstream of the nipple 116. In these embodiments, the nipple 116 may further define a locking recess 117 that may engage with the locking assembly 132 of the locking mandrel 130 to secure the isolation tool 120 within the subsurface safety valve 100, as will be described in additional detail herein.

Referring still to FIG. 3, in the embodiments described herein, the shoulder 131 of the upper portion 124*a* of the body 124 of the isolation tool 120 may be a no-go shoulder, which may engage at least a portion of the nipple 116 to secure the upper portion 124*a* of the isolation tool 120. With the shoulder 131 engaged with the nipple 116, the locking mandrel 130 may act to lock the upper portion 124*a* of the isolation tool 120 to nipple 116 by engaging the locking recess 117 of the nipple 116, thereby securing the isolation tool 120 within the subsurface safety valve 100.

Referring still to FIG. 3, in these embodiments, the lower portion 124*b* of the body 124 including the sleeve 127 may extend into and through the interior bore 104 of the subsurface safety valve 100, such that the sleeve 127 extends through the hinged valve 108 (shown in FIGS. 1A and 1B) and secures the hinged valve 108 in the open position. In the embodiments described herein, the sleeve 127 of the lower portion 124*b* of the body 124 may be shaped to conform to the interior bore 104 of the subsurface safety valve 100. For example, in the embodiment depicted in FIG. 3, the lower portion 124*b* of the body 124 may be shaped to conform to the interior bore 104 of the subsurface. Thus, although the body 124 is depicted as having a generally tubular shape, it should be understood that the lower portion 124*b* of the body 124 may take any shape (e.g., rectangular, etc.) such that the exterior surface corresponds to the shape of the interior bore 104.

Furthermore, the isolation tool 120 may be positioned within the interior bore 104 of the subsurface safety valve 100 such that a safety clearance C exists between the sleeve 127 of the lower portion 124*b* of the isolation tool 120 and the interior bore 104 of the subsurface safety valve 100. The safety clearance C may act to eliminate friction (e.g., between the isolation tool 120 and the subsurface safety valve 100) during operation and may further help to ensure safe passage of the isolation tool 120 within the subsurface safety valve 100. In the embodiments described herein, the safety clearance C may be defined as a distance (e.g. in the +/−x-direction as depicted in the coordinate axis of FIG. 3) between an outer surface of the sleeve 127 and an inner surface of the interior bore 104. The safety clearance may be between greater than or equal to 0.1 inches and less than or equal to 0.5 inches, or greater than or equal to 0.2 inches and less than or equal to 0.3 inches.

Referring now to FIGS. 1-3, operation and installation of the isolation tool 120 within the subsurface safety valve 100 will now be described. Initially, the isolation tool 120 may be installed within the subsurface safety valve 100 by attaching the isolation tool 120 to a slickline or wireline. More particularly, the slickline or wireline may be coupled to the fishneck 125 formed on the upper portion 124*a* of the body 124 of the isolation tool 120. Once the isolation tool 120 and the slickline are coupled, the slickline may be run into the subsurface safety valve 100.

As the slickline and isolation tool 120 are lowered, the hinged valve 108 of the subsurface safety valve 100 may be opened by adjusting the pressure in the control line 109, as has been described herein. With the hinged valve 108 moved to the open position, the slickline and isolation tool 120 may be lowered into the interior bore 104 of the subsurface safety valve 100, such that the lower portion 124*b* of the body 124 may extend into and through the hinged valve 108 and the interior bore 104 and the shoulder 131 of the isolation tool 120 contacts the nipple 116 of the subsurface safety valve 100. Once the isolation tool 120 is appropriately positioned, the locking mandrel 130 may couple the isolation tool 120 to the nipple 116 of the subsurface safety valve 100, at which point the slickline or wireline may be detached from the isolation tool and withdrawn.

Furthermore, once the isolation tool 120 has been installed within the interior bore 104 of the subsurface safety valve 100, a user may ensure that the coupling between the isolation tool 120 and the subsurface safety valve 100 is of a desired integrity. More specifically, testing may be conducted to ensure that no defects are present between the isolation tool 120 and the subsurface safety valve 100. Ensuring the integrity of the coupling between the isolation tool 120 and the subsurface safety valve 100 may serve to eliminate the risk of the hinged valve 108 inadvertently closing during wellbore production, as has been described herein.

With the isolation tool 120 positioned and secured within the subsurface safety valve 100, the lower portion 124*b* of the body 124 (e.g., the portion which extends into and through the interior bore 104 and hinged valve 108) of the isolation tool 120 may act to lock the hinged valve 108 in the opened position. For example, with the isolation tool 120 positioned, the hinged valve 108 may be incapable of moving from the open position to the closed position, as the lower portion 124*b* of the body 124 acts to obstruct the hinged valve 108. In these embodiments, if the hinged valve 108 suffers a malfunction, the lower portion 124*b* of the body 124 of the isolation tool 120 may contact the hinged valve 108, such that the hinged valve 108 is held in the open position. With the hinged valve 108 secured in the open position, the malfunction may be addressed by a user without suffering damage and/or loss to any tool strings, wirelines, and/or fishing tools that may be operating in the wellbore at the time of the malfunction.

Figure 4:
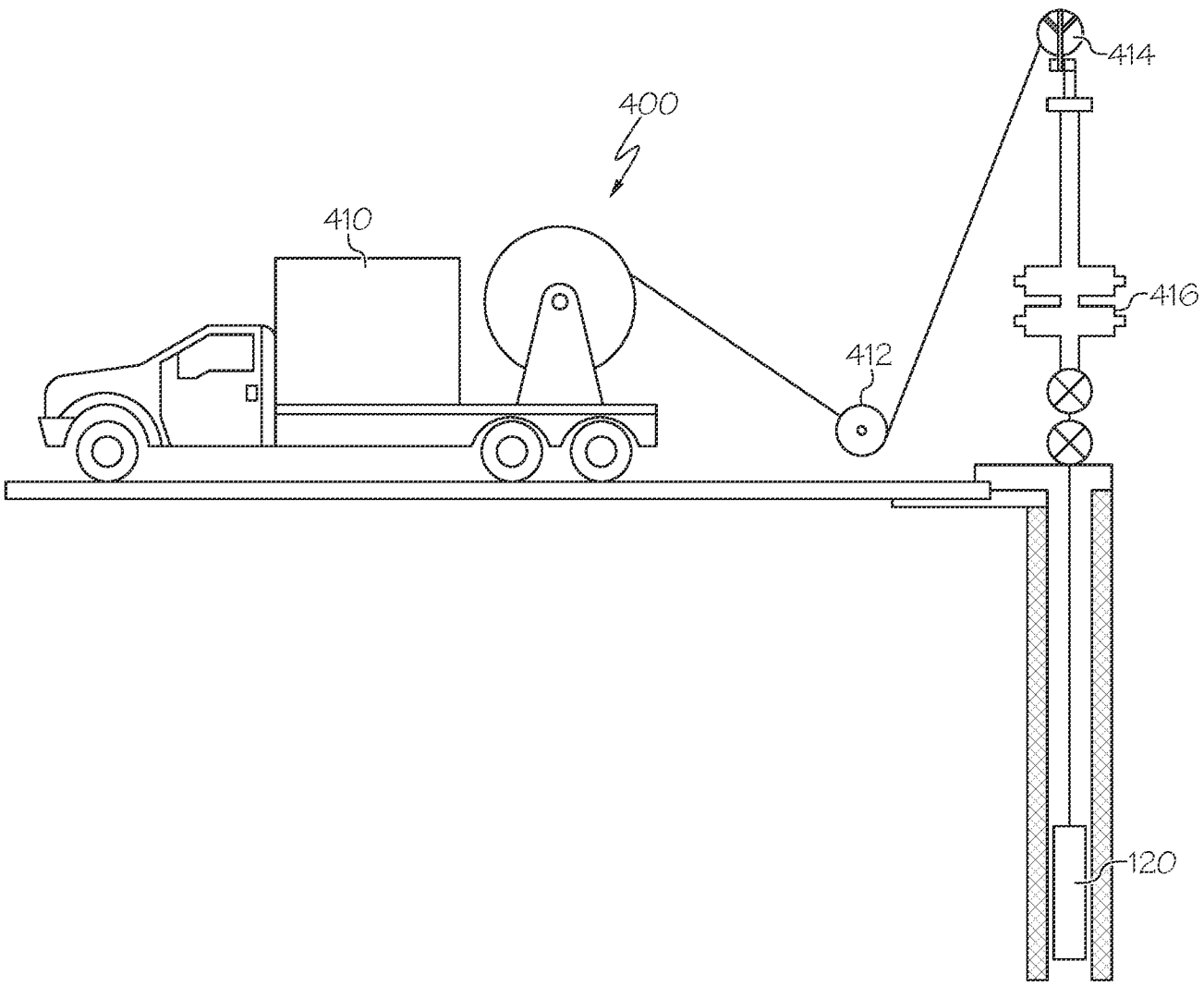
FIG. 4 depicts a schematic view of a slickline rig utilizing the isolation tool and subsurface safety valve of FIG. 3.

Turning now to FIG. 4, a schematic view of a slickline rig 400 utilizing the isolation tool 120 and subsurface safety valve 100 is depicted. In these embodiments, the hinged valve 108 of the subsurface safety valve 100 may be moved the open position using the control line 109 and hydraulic valve assembly 110, as has been described in detail herein with reference to FIGS. 1 and 3. With the subsurface safety valve 100 in the open position, the isolation tool 120 may be coupled to a slickline unit 410 and adjusted such that the slickline on which the isolation tool 120 is coupled is engaged with a wheel, such as a sheave wheel 412. The slickline may be further fed through a box, such as a stuffing box 414, and lubricator 416, which may provide lubrication to the slickline as the isolation tool 120 is deposited within the wellbore and into the subsurface safety valve 100.

In these embodiments, the isolation tool 120 may be forced downstream via the slickline rig 400 until the shoulder of the isolation tool 120 engages the nipple of the subsurface safety valve, at which point the isolation tool 120 may be locked into the subsurface safety valve 100. With the subsurface safety valve 100 secured, the slickline rig 400 may be decoupled from the isolation tool 120 and withdrawn from the wellbore.

In the embodiments described herein, a method of coupling an isolation tool to a subsurface safety valve is also disclosed. The method may begin with positioning a subsurface safety valve having an interior bore into a wellbore. The subsurface safety valve may be positioned in the wellbore via a slickline or any other suitable means.

With the subsurface safety valve positioned in the wellbore, the method may further involve translating a valve, such as a hinged valve, of the subsurface safety valve from a closed position to an open position. With the valve in the open position, the method may further involve coupling an isolation tool having a body including an upper portion and a lower portion to a wireline.

In these embodiments, the method may also involve positioning the isolation tool within the interior bore of the subsurface safety valve, such that the isolation tool extends into and through the valve and the interior bore of the subsurface safety valve. For example, in these embodiments, the isolation tool may be positioned within the subsurface safety valve such that the lower portion of the body of the isolation tool obstructs the valve, thereby preventing the valve from moving from the open position to the closed position. Furthermore, in these embodiments, the upper portion of the body of the isolation tool may be positioned such that a shoulder of the upper portion contacts a nipple formed within the subsurface safety valve. In these embodiments, the shoulder of the upper portion of the body of the isolation tool may be further aligned with the nipple such that a locking mandrel formed on the upper portion of the body is aligned with a locking recess formed within the nipple.

With the isolation tool positioned within the subsurface safety valve, the method may further involve securing the isolation tool to the subsurface safety valve. For example, in some embodiments, the method may involve locking the upper portion of the isolation tool to the subsurface safety valve in order to ensure that the isolation tool does not become dislodged during wellbore production. In particular, the locking mandrel of the upper portion of the isolation tool may be coupled to the locking recess of the nipple of the subsurface safety valve to secure the isolation tool within the subsurface safety valve.

Once the isolation tool is secured to the subsurface safety valve, in some embodiments, the method may further involve testing an integrity of the coupling between the isolation tool and the subsurface safety valve, as is depicted at block 550. In the event the integrity of the coupling between the isolation tool and the subsurface safety valve is confirmed, the method may further involve decoupling the wireline from the isolation tool and removing the wireline from the wellbore, respectively. With the isolation tool secured to the subsurface safety valve and the wireline removed, wellbore production activities may be commenced.

As should be appreciated in view of the foregoing, a subsurface safety valve, isolation tool, and method of locking a subsurface safety valve are described herein. The subsurface safety valve includes an interior bore extending along an entire length of the subsurface safety valve, a valve actuatable between an open position and a closed position, and a locking recess for securing an isolation tool within the interior bore. The isolation tool includes a locking mandrel having a fish neck disposed on an upper surface of the locking mandrel, the locking mandrel engaging the locking recess of the subsurface safety valve, and a sleeve threadedly coupled to the locking mandrel. A hydraulic valve assembly is disposed fluidly downstream of the locking recess, the hydraulic valve assembly having one or more apertures fluidly coupling an upper portion of the wellbore to a lower portion of the wellbore. A control line controls the subsurface safety valve at a surface of the wellbore. By securing (e.g., locking) the subsurface safety valve in the open position, the disclosed isolation tool may act as a safeguard to ensure that sudden malfunction of the valve is prevented during wellbore operations.

Embodiments may be further described with reference to the following numbered clauses:

Clause 1. A subsurface safety valve comprising: an interior bore extending along an entire length of the subsurface safety valve; a valve actuatable between an open position and a closed position, wherein the valve creates a fluid-tight seal with the interior bore in the closed position; a locking recess for securing an isolation tool within the interior bore, wherein the isolation tool comprises: a locking mandrel having a fish neck disposed on an upper surface of the locking mandrel, the locking mandrel being configured to engage the locking recess of the subsurface safety valve; and a sleeve threadedly coupled to the locking mandrel, the sleeve including a tubular body having an exterior surface shaped to correspond with the interior bore of the subsurface safety valve, and an interior surface defining an internal bore for use in a wellbore; an hydraulic valve assembly disposed fluidly downstream of the locking recess, the hydraulic valve assembly having one or more apertures fluidly coupling an upper portion of the wellbore to a lower portion of the wellbore; and a control line for controlling the subsurface safety valve at a surface of the wellbore.

Clause 2. The subsurface safety valve of clause 1, wherein the valve is configured to fully open when the isolation tool is installed in the subsurface safety valve.

Clause 3. The subsurface safety valve of clauses 1 or 2, wherein the isolation tool is installed in the wellbore via a slickline.

Clause 4. The subsurface safety valve of ant of clauses 1-3, wherein a safety clearance exists between the tubular body of the sleeve of the isolation tool and the interior bore of the subsurface safety valve.

Clause 5. The subsurface safety valve of ant of clauses 1-4, wherein the isolation tool fluidly isolates the interior bore of the subsurface safety valve and the control line from fluid in the wellbore.

Clause 6. The subsurface safety valve of ant of clauses 1-5, wherein the locking mandrel of the isolation tool further comprises a plurality of locking keys configured to lock the locking mandrel in an open position.

Clause 7. The subsurface safety valve of ant of clauses 1-6, wherein the locking mandrel of the isolation tool further comprises a spring mechanism for locking the plurality of locking keys of the locking mandrel in the open position.

Clause 8. The subsurface safety valve of ant of clauses 1-7, wherein the upper surface of the locking mandrel further includes a shoulder configured to engage the locking recess of the subsurface safety valve.

Clause 9. An isolation tool for a subsurface safety valve, the isolation tool comprising: a locking mandrel configured to engage a locking recess of the subsurface safety valve, the locking mandrel comprising: a fish neck disposed on an upper surface of the locking mandrel; and a plurality of locking keys configured to lock the locking mandrel in an open position; and a sleeve threadedly coupled to the locking mandrel, the sleeve including a tubular body having an exterior surface shaped to correspond with an interior bore of the subsurface safety valve, and an interior surface defining an internal bore for use in a wellbore; wherein, when the isolation tool is coupled to the subsurface safety valve, a safety clearance exists between the tubular body of the sleeve and the subsurface safety valve.

Clause 10. The isolation tool of clause 9, wherein the locking mandrel is coupled to a slickline for positioning the isolation tool within the subsurface safety valve.

Clause 11. The isolation tool of any of clauses 9-10, wherein the locking mandrel further comprises a spring mechanism for locking the plurality of locking keys of the locking mandrel in the open position.

Clause 12. The isolation tool of any of clauses 9-11, wherein the upper surface of the locking mandrel further includes a shoulder configured to engage the locking recess of the subsurface safety valve.

Clause 13. A method of coupling an isolation tool to a subsurface safety valve, the method comprising: positioning a subsurface safety valve having an interior bore into a wellbore; coupling a slickline to a locking mandrel of the isolation tool; positioning the isolation tool within the interior bore of the subsurface safety valve in the wellbore; securing the isolation tool to the subsurface safety valve by coupling the locking mandrel of the isolation tool to a locking recess of the subsurface safety valve; testing the integrity of the coupling between the isolation tool and the subsurface safety valve; decoupling the slickline from the isolation tool; and removing the slickline from the wellbore.

Clause 14. The method of clauses 13, further comprising equalizing pressure between an upper portion of the wellbore and a lower portion of the wellbore using an hydraulic valve assembly disposed on the isolation tool.

The terminology used herein is for the purpose of describing particular aspects only and is not intended to be limiting. As used herein, the singular forms “a,” “an,” and “the” are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. The term "or a combination thereof" means a combination including at least one of the foregoing elements.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A system comprising:

a subsurface safety valve and an isolation tool, wherein:

the subsurface safety valve comprises:

an interior bore of the subsurface safety valve extending along an entire length of the subsurface safety valve;

a valve actuatable between an open position and a closed position, wherein the valve creates a fluid-tight seal with the interior bore in the closed position;

a locking recess for securing an isolation tool within the interior bore of the subsurface safety valve;

a hydraulic valve assembly disposed fluidly downstream of the locking recess, the hydraulic valve assembly coupling an upper portion of a wellbore to a lower portion of the wellbore; and a control line for controlling the subsurface safety valve at a surface of the wellbore; and the isolation tool comprises:

a locking mandrel having a fish neck disposed on an upper surface of the locking mandrel, the locking mandrel being configured to engage the locking recess of the subsurface safety valve; and a sleeve threadedly coupled to the locking mandrel, the sleeve including a tubular body having an exterior surface shaped to correspond with the interior bore of the subsurface safety valve, and an interior surface defining an internal bore of the isolation tool extending through the subsurface safety valve for use in the wellbore.

2. The system of claim 1, wherein the valve is configured to fully open when the isolation tool is installed in the subsurface safety valve.

3. The system of claim 1, wherein the isolation tool is installed in the wellbore via a slickline.

4. The system of claim 1, wherein a safety clearance exists between the tubular body of the sleeve of the isolation tool and the interior bore of the subsurface safety valve.

5. The system of claim 1, wherein the isolation tool fluidly isolates the interior bore of the subsurface safety valve and the control line from fluid in the wellbore.

6. The system of claim 1, wherein the locking mandrel of the isolation tool further comprises a plurality of locking keys configured to lock the locking mandrel in the open position.

7. The system of claim 6, wherein the locking mandrel of the isolation tool further comprises a mandrel spring mechanism for locking the plurality of locking keys of the locking mandrel in the open position.

8. The system of claim 1, wherein the upper surface of the locking mandrel further includes a shoulder configured to engage the locking recess of the subsurface safety valve.

9. An isolation tool for a subsurface safety valve comprising a locking recess and an interior bore, the isolation tool comprising:

a locking mandrel configured to engage the locking recess of the subsurface safety valve, the locking mandrel comprising:

a fish neck disposed on an upper surface of the locking mandrel; and a plurality of locking keys configured to lock the locking mandrel in an open position; and a sleeve threadedly coupled to the locking mandrel, the sleeve including a tubular body having an exterior surface shaped to correspond with the interior bore of the subsurface safety valve, and an interior surface defining an internal bore of the isolation tool extending through the subsurface safety valve for use in a wellbore;

wherein, when the isolation tool is coupled to the subsurface safety valve, a safety clearance exists between the tubular body of the sleeve and the subsurface safety valve.

10. The isolation tool of claim 9, wherein the locking mandrel is coupled to a slickline for positioning the isolation tool within the subsurface safety valve.

11. The isolation tool of claim 9, wherein the locking mandrel further comprises a spring mechanism for locking the plurality of locking keys of the locking mandrel in the open position.

12. The isolation tool of claim 9, wherein the upper surface of the locking mandrel further includes a shoulder configured to engage the locking recess of the subsurface safety valve.

13. A method of coupling an isolation tool to a subsurface safety valve, the method comprising:

positioning the subsurface safety valve having an interior bore into a wellbore;

coupling a slickline to a locking mandrel of the isolation tool, wherein the isolation tool comprises an internal bore configured to extend through the subsurface safety valve;

positioning the isolation tool within the interior bore of the subsurface safety valve in the wellbore;

securing the isolation tool to the subsurface safety valve by coupling the locking mandrel of the isolation tool to a locking recess of the subsurface safety valve;

testing the integrity of the coupling between the isolation tool and the subsurface safety valve;

decoupling the slickline from the isolation tool; and removing the slickline from the wellbore.

14. The method of claim 13, further comprising equalizing pressure between an upper portion of the wellbore and a lower portion of the wellbore through the internal bore of the isolation tool.

* * * * *